United States Patent [19]

Harris

[11] Patent Number: 4,688,378

[45] Date of Patent: Aug. 25, 1987

[54] ONE PIECE BAND SEAL

[75] Inventor: Harold S. Harris, Glastonbury, Conn.

[73] Assignee: United Technologies Corporation, Hartford, Conn.

[21] Appl. No.: 735,309

[22] Filed: May 20, 1985

Related U.S. Application Data

[63] Continuation-in-part of Ser. No. 560,616, Dec. 12, 1983, abandoned.

[51] Int. Cl.[4] ..... F02C 7/20; F02G 3/00

[52] U.S. Cl. ..... 60/39.32; 60/39.36; 60/39.75; 415/138; 415/170 R; 277/218

[58] Field of Search ..... 60/39.75, 39.31, 39.32, 60/39.36; 415/134–139, 170 R, 217, 218; 277/188, 193, 216–219, 223, 224

[56] References Cited

U.S. PATENT DOCUMENTS

| | | | |
|---|---|---|---|
| 418,518 | 12/1889 | Jerome | 277/223 |
| 2,532,180 | 11/1950 | Moore | 277/218 |
| 3,062,499 | 11/1962 | Peterson | 415/137 |
| 3,295,824 | 1/1967 | Woodwell et al. | 415/178 |
| 3,565,545 | 2/1971 | Bobo et al. | 60/39.75 |
| 4,149,373 | 4/1979 | Jones et al. | 60/39.36 |
| 4,251,986 | 2/1981 | Thompson et al. | 60/39.36 |

*Primary Examiner*—Carlton R. Croyle
*Assistant Examiner*—Donald E. Stout
*Attorney, Agent, or Firm*—Charles A. Warren

[57] ABSTRACT

A one-piece seal which surrounds the end of the burner duct to prevent leakage of high pressure air into the turbine inlet.

6 Claims, 5 Drawing Figures

ONE PIECE BAND SEAL

CROSS REFERENCE TO RELATED APPLICATION

This is a continuation-in-part of application Ser. No. 560,616 filed on Dec. 12, 1983, now abandoned.

This invention relates to the invention disclosed in copending patent application entitled ONE PIECE BAND SEAL and filed by Harold S. Harris on Dec. 12, 1983 and assigned to the same assignee as this patent application.

TECHNICAL FIELD

The seal at the downstream end of the annular burner in a jet engine which serves to prevent leakage of high pressure air into the turbine inlet is an adjustable one piece seal.

BACKGROUND ART

The seal which surrounds the end of the burner duct to minimize leakage of high pressure air from the area surrounding the burner into the turbine inlet has been made of three pieces, two segmental seal elements that cooperate to form a complete annular seal and the surrounding band that holds the segmental elements in position. The band must have interlocking elements with the seal segments to prevent rotation of the band during engine operation and the seal segments must be separately positioned on the burner duct to retain them in their desired relation to the cooperating seal elements forming a part of the burner duct. The three piece seal structure is necessarily more complicated to manufacture and assemble then would be a single piece band and it is desirable in this location to minimize the number of parts and the complexity of the assembly of the parts.

DISCLOSURE OF INVENTION

According to the present invention the seal structure is a one piece band having flanges at opposite ends by which the ends are bolted together against the opposite side of a spacer that establishes the exact circumference of the assembled band and thus determines the pressure exerted on the burner ring against which the band is clamped. The band serves as the seal element and clamp and is supported in position by lugs fitting over positioning bolts in the surrounding case. Springs urge the seal element securely against the outer shrouds of the turbine vanes to provide an effective seal at the vane platform.

The use of a spacer permits the adjustment of each band to the precise diameter needed for the exact fit desired on the burner ring. That is to say, by the choice of the proper thickness of spacer the diameter of the band may be made to fit the burner ring in spite of tolerance buildup in successive engines. Thus a minimum of clearance may be provided in each engine so that sliding may occur between the band and the surrounded structure but with no significant air leakage.

Other objects, features and advantages of the present invention will become more apparent in the light of the following detailed description of the preferred embodiments thereof as shown in the accompanying drawing.

BEST MODE FOR CARRYING OUT THE INVENTION

Figures 1, 2, 3, 4, 5:
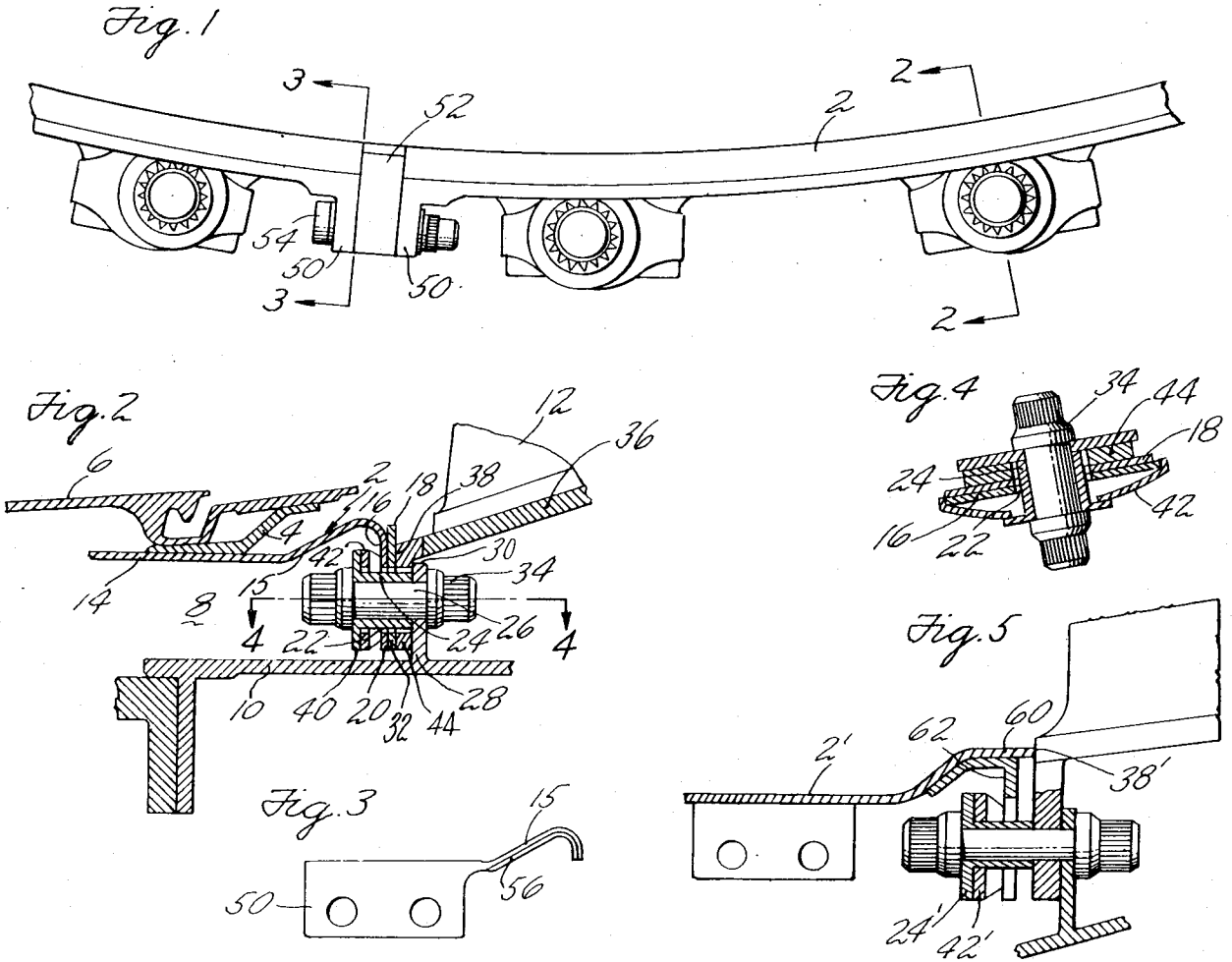
FIG. 1 is a transverse end view of the seal band and associated structure.
FIG. 2 is a sectional view along the line 2—2 of FIG. 1.
FIG. 3 is a an end view of the flange on the seal band substantially along the line 3—3 of FIG. 1.
FIG. 4 is a detailed sectional view along the line 4—4 of FIG. 2.
FIG. 5 view is similar to FIG. 2 of a modification.

With reference first to FIGS. 1 and 2 a sealing band 2 surrounds the annulus 4 attached to the downstream end of the outer wall 6 of the annular burner. The seal band 2 cooperates with the annulus 4 to minimize leakage of high pressure air from the space 8 between the outer wall 6 and the surrounding burner case 10 into the space just upstream of the first row of turbine vanes 12 only one of which is shown. This arrangement permits expansion of the burner wall since the annulus 4 may slide axially within the band 2.

This band is essentially cylindrical in the portion 14 surrounding the annulus 4. Downstream of the cylindrical portion 14 is a conical portion 15 and then an outwardly curving portion to terminate in a flat disk portion 16 the downstream side of which rests against a disc 18. Tabs 20 extending outwardly from the flat portion 16 have holes 22 therein to fit over flanged sleeves 24 such that circumferential and radial motion of the tabs is permitted to a limited extent that these tabs serve to support the band in the desired position surrounding the annulus 4.

The sleeves 24 are positioned on bolts 26 extending therethrough. These bolts fit in the annulus 28 formed by flanges 30 extending inwardly from the burner case 10 as shown. The disc 18 is also guided by the sleeves, the disc having tabs 32 similar to the tabs 20 on the seal. Suitable nuts 34 on the ends of the bolts 26 hold them securely in position with the flanged sleeve engaging the flanges 30.

The first stage turbine vanes have outer shrouds 36 that have an upstream flat surface 38 against which the disc 18 engages. The several outer shrouds for the row of vanes form a substantially continuous circumferential surface for the entire periphery of the engine at this point.

The flanges 40 on the sleeves 20 are spaced from the flange 30 and provide clearance for leaf springs 42 that extend over each tab 20 and are rebent at opposite ends to engage on opposite ends of the tabs 20 as shown so that the spring is retained in proper position. These springs urge the disc 18 against the surface 38 to prevent gas leakage at this point. The clearance is maintained by the length of the sleeve that is clamped between the bolthead and the flange 30.

Each vane has an outwardly extending flange 44 that fits over the sleeve 24 against the flange 30 and there is clearance around this sleeve at this point to permit slight circumferential and radial movement of the vane relative to the supporting sleeve.

The opposite ends of the seal band have flanges 50 thereon by which the ends of the band are clamped against opposite sides of the spacer block 52 and bolts 54 extend through the flanges and this block. The block is dimensioned to assure the proper spacing at the ends of the band to assure a precise circumferential dimension at the sealing surface so as to control the pressure exerted by the band on the annulus 4.

The important feature is the size adaptation of the seal band 2 to the annulus 4 surrounded by it since tolerance limits result in minor differences in dimension of the parts. Thus if the annulus 4 is on the large side of the permitted tolerance and the band on the small side of the permitted tolerance, the fit would be too tight to allow the desired sliding movement. By splitting the band and placing the properly dimensioned spacer between the ends, the band may be adjusted to exactly the necessary dimension. Obviously, with a plurality of spacers of slightly different thicknesses, the proper thickness of spacer will give precisely the necessary band dimension. This permits adjustment of the dimension of the band to accommodate whatever the tolerance is in the annulus surrounded by the band.

Thus the flanges and spacers permit the creation of a band having precisely the required dimension to permit the desired sliding movement but with an adequately tight fit on the annulus to minimize air leakage. It is therefore possible to adjust the seal band to account for tolerance buildings in successively assembled engines so that each seal band is tailored to fit the particular engine during the assembly process.

Where the ends of the band do not meet at the block the conical portion of the band has a short segmental piece 56 of similar shape welded to one end of the band and extending across the spacing of the block to underlie and be in contact with the opposite end of the band in this area.

Thus the cylindrical portion of the band seals against the annulus 4 and the flat outer end seals against the disc 18. The disc 18 in turn seals against the outer shroud of the turbine vane with leaf springs assuring contact at these points. Obviously, the leaf spring urges the flat outer end of the seal against the disc and the disc in turn is urged against the turbine vane shrouds. The segmental piece 56 seals across spacer block for the remainder of the periphery for the seal band.

A modification of the above structure shown in FIG. 5 provides a different seal at the turbine shroud. The band 2' instead of being curved near its rearward end is cylindrical at 60 and at a diameter to engage directly endwise with the turbine vane outer shrouds 38'. Tabs 62 welded to the band on the outer surface fit over sleeves 24' and are urged by the springs 42' rearwardly so that the band 2' is held in axial contact with the shrouds. The band 2' is in other respects similar to the band 2 and is cylindrical where it engages with the end of the burner wall.

It should be understood that the invention is not limited to the particular embodiments shown and described herein, but that various changes and modifications may be made without departing from the spirit and scope of this novel concept as defined by the following claims.

I claim:

1. A seal structure for a gas turbine engine having a burner case, said structure being adapted for sealing between an outer wall of a burner having a downstream end and a turbine inlet downstream of the burner, said structure being slidable on the burner wall and including:

a single circumferentially extending band having flanges at opposite ends to form the band into a ring, a spacer positioned between the band ends to establish a predetermined spacing between the ends and thus establish a precise circumferential dimension for the band and spacer when assembled to assure a dimension within which the burner wall will slide, said band having a cylindrical portion to cooperate with and slide on a similar surface forming a part of the end of the burner wall, and a radially extending flat portion spaced axially from the cylindrical portion to cooperate with a corresponding radial surface at the turbine inlet.

2. A seal structure as in claim 1 in which bolts extending through the end flanges and the spacer block secure the band into a continuous circle.

3. A seal structure as in claim 1 in which the radially extending flat portion has tabs extending outwardly by which to position the ring within the burner case.

4. A seal structure for a gas turbine engine for sealing between the downstream end of an outer wall of a burner on which the seal structure is slidable and a turbine inlet adjacent thereto to which the seal structure is secured, said structure consisting of:

a single circumferentially extending band having flanges at its opposite ends by which to form the band into a ring, and a spacer positioned between the band ends to establish a predetermined spacing between the flanges at the band ends and thus establish a precise circumferential dimension for the band and spacer when assembled to assure a ring dimension that will allow the end of the burner wall to slide therein, said band and spacer constituting the entire seal structure to cooperate with the downstream end of the outer wall of the burner.

5. A seal structure as in claim 4 in which the band and spacer are held together by bolts extending through said flanges and the spacer.

6. A seal structure as in claim 4 in which the band has a cylindrical portion to fit around a cylindrical ring on the burner and a radially extending portion to cooperate with a radial surface at the turbine inlet.

* * * * *